US006837723B1

(12) United States Patent
Randall et al.

(10) Patent No.: US 6,837,723 B1
(45) Date of Patent: Jan. 4, 2005

(54) SELF-ACTUATING CONNECTOR FOR COUPLING MICROCOMPONENTS

(75) Inventors: John N. Randall, Richardson, TX (US); Matthew D. Ellis, Allen, TX (US)

(73) Assignee: Zyvex Corporation, Richardson, TX (US)

( * ) Notice: Subject to any disclaimer, the term of this patent is extended or adjusted under 35 U.S.C. 154(b) by 69 days.

(21) Appl. No.: 10/154,685

(22) Filed: May 24, 2002

(51) Int. Cl.[7] ..... H01R 13/20
(52) U.S. Cl. ..... 439/161; 439/259
(58) Field of Search ..... 439/161, 259

(56) References Cited

U.S. PATENT DOCUMENTS

| | | | | |
|---|---|---|---|---|
| 3,268,774 A | | 8/1966 | Ortner | |
| 3,439,416 A | | 4/1969 | Yando | |
| 3,467,942 A | | 9/1969 | Dell et al. | |
| 3,588,618 A | * | 6/1971 | Otte | 439/161 |
| 4,141,138 A | | 2/1979 | Quick | |
| 4,740,410 A | | 4/1988 | Muller et al. | |
| 4,955,814 A | | 9/1990 | Christie et al. | |
| 4,969,827 A | | 11/1990 | Hahs, Jr. | |
| 5,092,781 A | * | 3/1992 | Casciotti et al. | 439/161 |
| 5,113,117 A | | 5/1992 | Brooks et al. | |
| 5,273,441 A | * | 12/1993 | Volz et al. | 439/161 |
| 5,411,400 A | | 5/1995 | Subrahmanyan et al. | |
| 5,539,200 A | | 7/1996 | Lebby et al. | |
| 5,645,684 A | | 7/1997 | Keller | |
| 5,660,680 A | | 8/1997 | Keller | |
| 5,746,621 A | * | 5/1998 | Cronin | 439/161 |
| 5,806,152 A | | 9/1998 | Saitou et al. | |
| 5,818,748 A | | 10/1998 | Bertin et al. | |
| 5,848,456 A | | 12/1998 | Sjoqvist | |
| 6,617,522 B2 | * | 9/2003 | Tabacutu | 439/161 |
| 6,764,325 B2 | * | 7/2004 | Arrigotti et al. | 439/161 |

FOREIGN PATENT DOCUMENTS

| | | |
|---|---|---|
| DE | 19746585 A1 | 4/1999 |
| EP | 0490530 A2 | 6/1992 |
| EP | 0497620 A2 | 8/1992 |
| WO | 97 13981 | 4/1997 |

OTHER PUBLICATIONS

Comtois, John H. et al. "Electrothermal actuators fabricated in four–level planarized surface micromachined polycrystalline silicon," Sensors and Actuators A70. (1998) pp. 23–31.

Comtois, John H. et al. "Applications for surface–micromachined polysilicon thermal actuators and arrays," Sensors and Actuators A58. (1997) 19–25.

Comtois, John H. et al. "Thermal Microactuators for surface–micromachining processes," SPIE vol. 2642. (1995) pp. 10–21.

(List continued on next page.)

*Primary Examiner*—Tho D. Ta
(74) *Attorney, Agent, or Firm*—Haynes and Boone, LLP

(57) ABSTRACT

A deflection element operating under control of selectively applied energy is used to achieve low insertion loss between mating elements. Once the elements are in proper relationship the deflection element is allowed to settle to its stable position thereby serving to lock the elements together.

12 Claims, 5 Drawing Sheets

OTHER PUBLICATIONS

Abstract of JP 57161819, Patent Abstracts of Japan vol. 007, No. 002. (May 10, 1982) p. 166.
Mohr, Jurgen. "LIGA– A Technology For Fabricating Microstructures and Microsystems," Sensors and Materials, vol. 10, No. 6 (1998) pp. 363–373.
"Chip–to–Chip Cable Connection," IBM Technical Disclosure Bulletin. IBM Corp., vol. 27, No. 11 (Apr. 1985) pp.6761–6763.
Arai, Fumihito, et al. "A New Pick up & Release Method By Heating For Micromanipulation," IEEE. (1997) pp. 383–388.
Hitikawa, Hajime. "Advanced Parts Orientation System has Wide Application," Assembly Automation, vol. 8, No. 3. (Aug. 1998) pp. 147–150.
Prasad, Rama et al. "Design, Fabrication, and Characterization of Single Crystal Silicon Latching Snap Fasteners For Micro Assembly," IMECE (Nov. 1995).
Hsi–Jen J. Yeh, et al. "Fluidic Self–Assembly of Microstructures and its Applications to the Integration of GaAs on Si," IEEE (1994) pp. 279–284.
Keller, C.G. et al. "Hexsil Tweezers For Teleoperated Micro–Assembly," IEEE (1997) pp. 72–77.
Cohn, Michael B. et al. "Microassembly Technologies for MEMS".
Keller, Chris. "Microfabricated High Aspect Ratio Silicon Flexures," (1998).
Cohn, et al. "Self– Assembling Electrical Networks: An Application of Micromachining Technology," IEEE. (1991) pp. 490–493.
Ezekiel , Richard Y., et al., "Surface–Micromachined Components for Articulated Microbots," Journal of Microelectromechanical Systems, vol. 5, No. 1. (Mar. 1996).
Fearing, Ronald S. "Survey of Sticking Effects for Micro Parts Handling," IEEE (1995) pp. 212–217.

* cited by examiner

SELF-ACTUATING CONNECTOR FOR COUPLING MICROCOMPONENTS

CROSS-REFERENCE TO RELATED APPLICATIONS

This application is related to commonly assigned U.S. patent application Ser. No. 09/570,170, filed May 11, 2000, entitled "SYSTEM AND METHOD FOR COUPLING MICROCOMPONENTS"; Ser. No. 09/569,328, filed May 11, 2000, entitled "RIBBON CABLE AND ELECTRICAL CONNECTOR FOR USE WITH MICROCOMPONENTS"; and Ser. No. 09/643,011, filed Aug. 21, 2000, entitled "SYSTEM AND METHOD FOR COUPLING MICROCOMPONENTS UTILIZING A PRESSURE FITTING RECEPTACLE"; incorporated by reference herein

FIELD OF THE INVENTION

This invention relates to micro/nanotechnology connectors and more particularly to a system and method for achieving low insertion force by controlled deformation of mating elements.

BACKGROUND OF THE INVENTION

In the above-referenced co-pending patent applications there are disclosed systems and methods for achieving low insertion force while bringing mating elements together in a micro/nanotech environment. Typically, to accomplish low, or ideally zero, insertion force between mating elements, some deflection of one of the mating elements must be achieved. This deflection comes about by using 'tweezers' that grab and squeeze a mating element. Using the tweezers, the deflected element to be mated is guided into a location where, when the force is removed, the friction that results from the undeflected element latches the parts together.

Such a procedure has an advantage since the element must be guided anyway, therefore applying pressure to deflect the element is a logical step in the guiding process. However, applying deflection forces in this manner presents some disadvantages, particularly when there are several connections to be made between elements. In such a situation, the element must be "grabbed" or deflected in several places at the same time.

Another problem is that the requirement to squeeze an element imposes constraints on the gripper mechanism and complicates the assembly tools and procedures. One such constraint is that the assembly gripper must then be designed for each individual element so as to achieve the proper gripping force, rotation, and mating relationships.

When the gripper device that is being used to position the element also supplies the deflection force it follows that when the deflection force is removed the maneuvering force is also removed, or lessened. In some situations, this is not desirable.

Also, self-centering and minor adjustments are necessary when elements are to be mated. Thus, any system that is designed to achieve the smooth mating of elements must also be designed to allow for slight adjustments. It follows then that when an element is being deflected by the tool that is also positioning that element any change in the pressure on the tool (release of the deflection) can also result in a change to the spatial orientation of the element.

BRIEF SUMMARY OF THE INVENTION

The present invention is directed to a system and method in which energy is applied to an element to be mated and the energy causes one or more of the mating elements to deflect enough to provide a low, or zero, insertion force Removal of the energy causes the element, or elements, to assume their static, or rest, shape, thereby increasing the friction (or other attractive force), or latching between the parts enough to cause the elements to resist separation. Positional adjustments can be made, either during the mating process or thereafter, by the selective application of energy to cause selective deformation.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which.

DETAILED DESCRIPTION OF THE INVENTION

Figure 1:
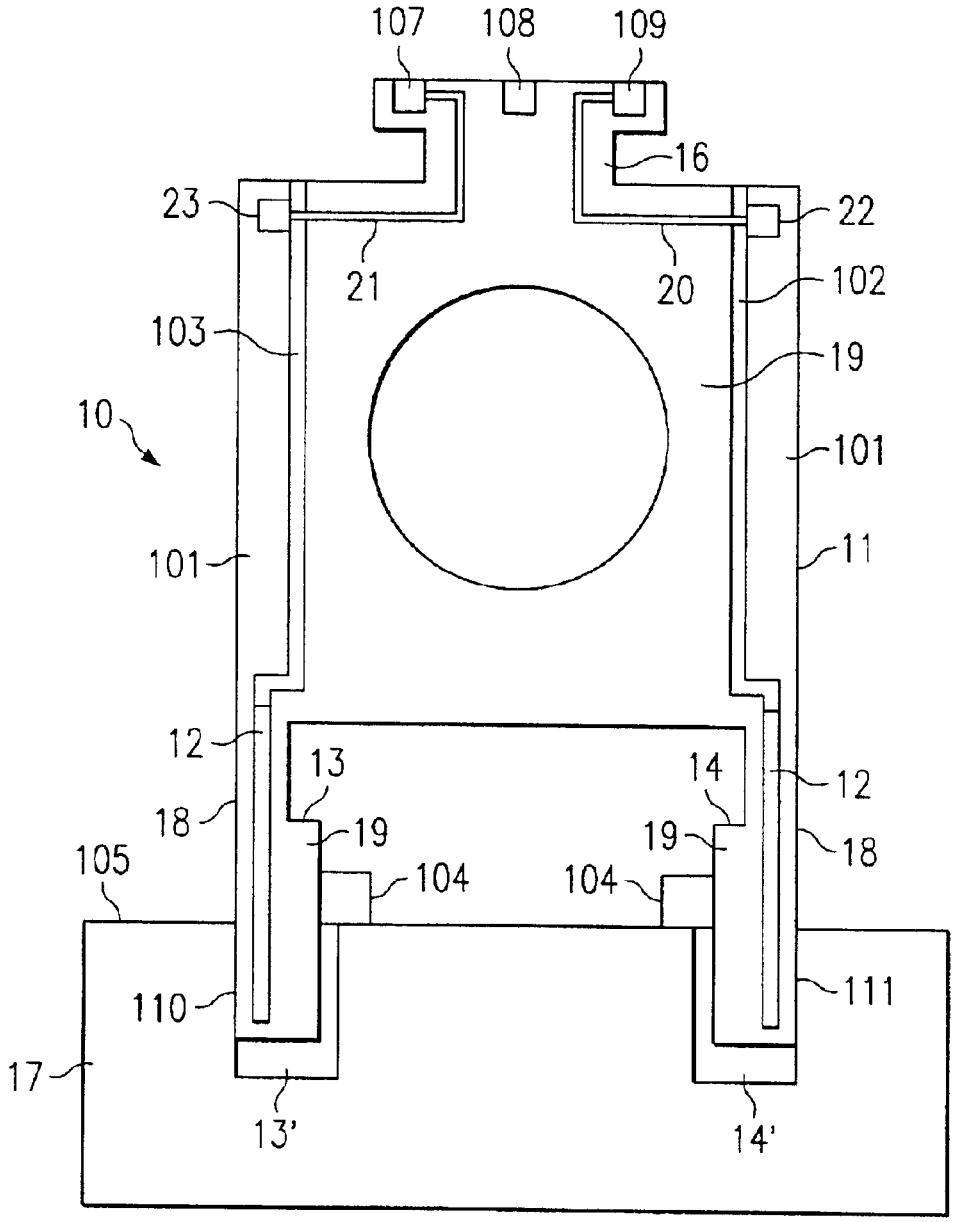
FIG. 1 shows a conceptual view of a device being mated to a surface using the system and method of our invention.

FIG. 1 shows system 10 with a conceptual view of actuator 11 which, for example, can be a snap connector of the type shown in the above-identified patent applications. At the top of actuator 11 is handle 16 used, if desired, to grip the connector and move it about. Shown on handle 16 are electrical (or other energy source) contacts 107, 108, and 109. In the embodiment shown, contact 108 is a direct ohmic contact to the electrically conducting body 19 (doped Si in this instance) of the connector. Contacts 107 and 109 as well as electrical traces 20 and 21 are separated from the body of connector 19 by a dielectric layer such as SiO2. Electrical traces 20 and 21 cross over dielectric trenches 102 and 103 and connect to contacts 22 and 23, respectively, so as to make electrical contact with conductor 101.

Electric current can be made to flow through connector 11 from contact 108 to 107 and 109. Because of the bilateral symmetry of the connector, we will only describe the electrical path from contact 109 to 108. With a potential difference between contacts 109 and 108, a current will flow from contact 109 through electrical trace 20 and contact 22 through conductor 101, through hot arm 18, back up through cold arm 19, into body 19 of activator 11, to contact 108. This current path is forced by dielectric filled trench 102 and air gap 12. Element 14 (and 13) is a thermal actuator which moves when hot arm 18 expands more than does cold arm 19 because of the larger current density in the hot arm leading to higher temperatures therein.

These elements 13 and 14 are designed to deflect inward a distance such that element 13 is centered within receptacle 13' of substrate 17, while element 14 is centered within receptacle 14'. If desired, stops 104 can be positioned to control the depth of the insertion within substrate 17. In the embodiment shown, the application of power to elements 12 cause legs 13 and 14 to deflect.

When the elements are positioned as desired, the energy can be fully, or partially, removed, allowing the deflected elements to assume their rest condition. In the embodiment shown, element 13 would then become positioned against side wall 110, while element 14 would be come positioned against side wall 111.

In an alternate embodiment, connector 11, or substrate 17, could be designed such that legs 13, 14 assume their steady-state condition. Further deflection, by one or more of legs 13, 14, could be achieved so as to increase the bonding (friction) forces. Also, selective additional deflection could be used to reposition the alignment of the connector.

Also note that during the insertion process, one or more elements to 13, 14 could be deformed and the deformation could be by selective amounts.

Also note, in the embodiment shown, the energy is an electrical current which causes a thermal (or other) change in the deflection element. The current can be removed while pressure is still being applied to handle 16. Other sources of energy could be used, such as, for example, thermal, and hydraulic.

In operation, once the current is removed, activator 11 becomes locked to substrate 17 by the outwardly applied restoring forces from elements 13, 14. Elements 13 and 14 will lock into mating slots 13' or 14', respectively, by friction, bonding (chemical or glue) or by latching, or a combination thereof. If it is desired to later separate the connector from the substrate, energy can be reapplied to terminals 107–109 (or by some other means) again causing the elements to deform to aid in the separation.

Also in operation, it is necessary to be able to send energy, such as electricity, through the conducting silicon so there needs to be a channel or pathway 101, 18, 19 through the silicon that separates one portion from another. Dielectric 102, 103 serve this function. Dielectric elements 102 and 103 are trenches etched in the body of the connector and filled with dielectric to provide a rigid connection between sections 101 and 19. To accomplish this, the process starts off as a flat piece of silicon, for example, SOI silicon, as a top layer. An offset is constructed underneath by etching or other process and dielectric 102, 103 is filled back into the etched channel. The dielectric can be an oxide or a nitride, which provides the mechanical contact between 101 and 19, and which provides the electrical isolation between the parts to allow for the deformation process.

Elements 13 and 14 can be thought of as a thermal bi-morph and operated because they have different cross-sections causing them to heat differently and thus bend as discussed above.

Figure 2:
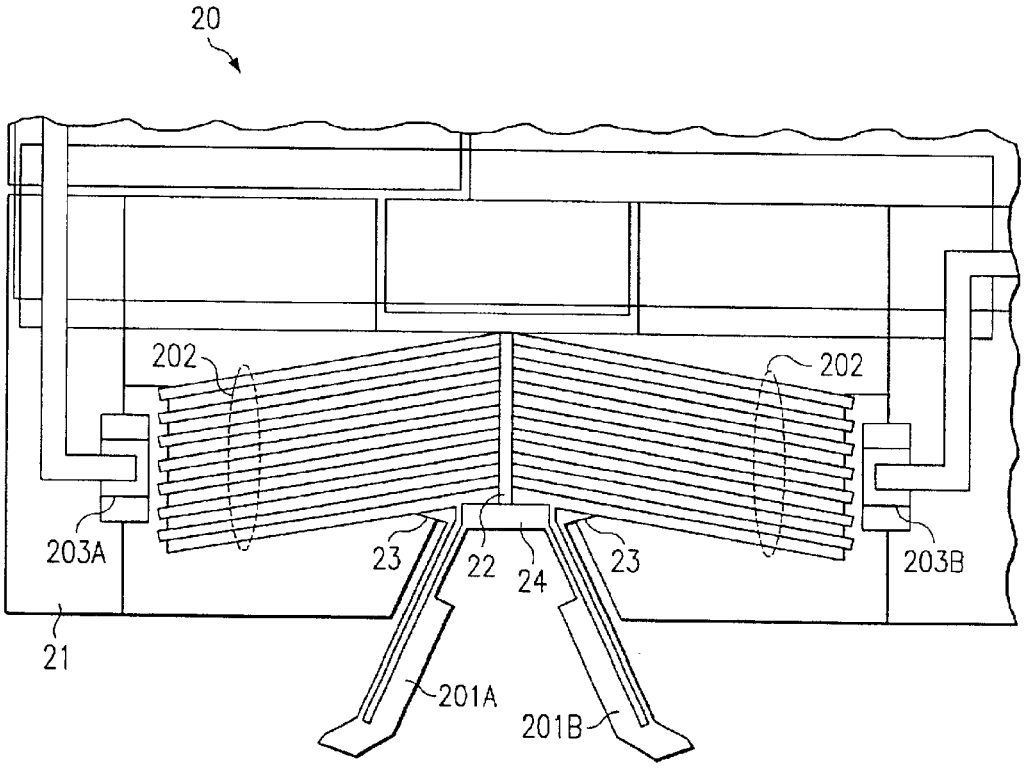
FIG. 2 shows one embodiment of our invention.

FIG. 2 shows connector 20 which is more in keeping with the type of connectors envisioned. Connector 20 includes power supply connectors 203A and 203B for delivering energy to deformable (movable) elements 202.

In operation, when energy is supplied, elements 202, on both sides of element 22 move upward under control of the supplied energy. Typically, this movement would be thermally induced. When these elements move upward they move element 22 upward, which, in turn, pulls bar 24 upward. Bar 24 moving upward causes arms 201A and 201B to pivot around points 23. As the arms pivot, mating elements 201A and 201B (which can be any shape) move closer together, in preparation, if so desired, for mating with another element (not shown). This type of bent beam actuator can be thought of as a thermally amplified actuator.

Figure 3:
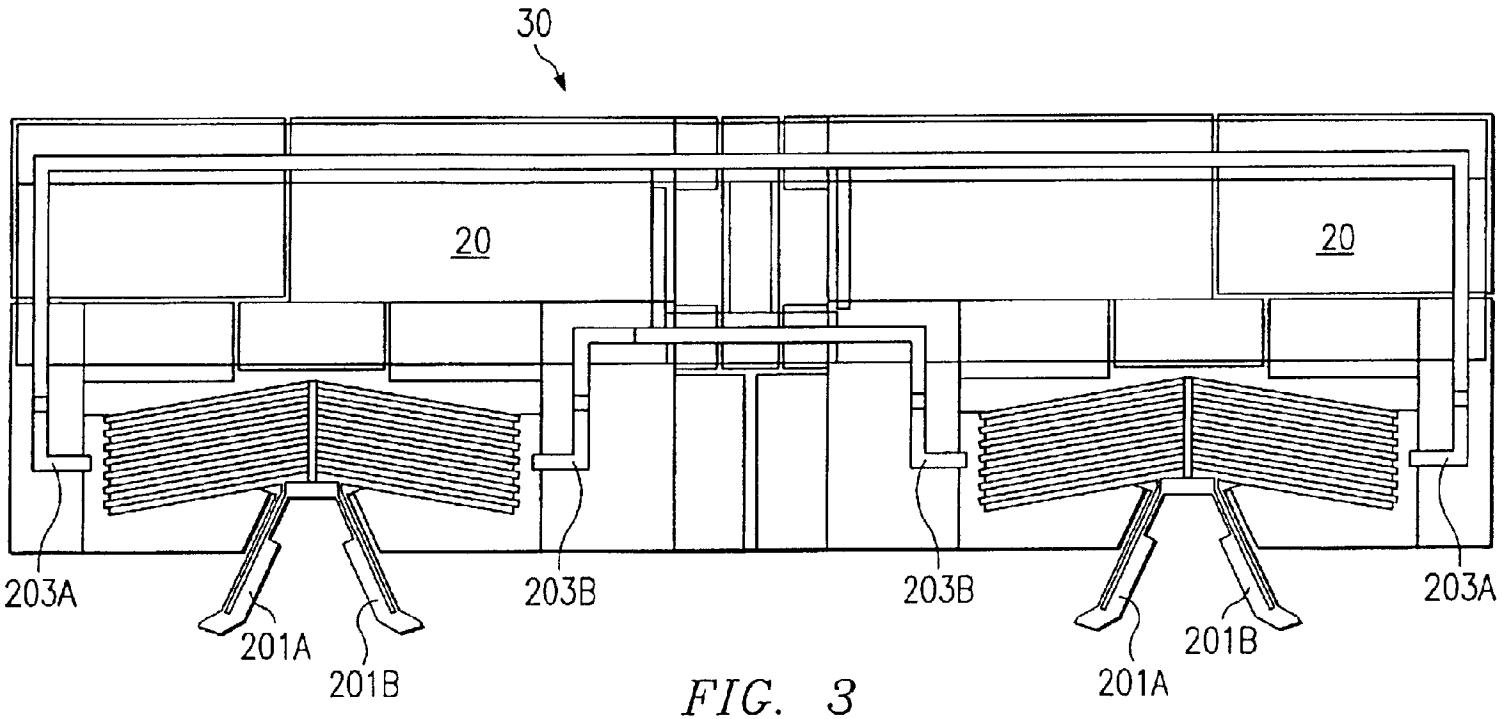
FIG. 3 shows the embodiment of FIG. 2 arranged in a multiple configuration.

FIG. 3 shows device 30 where two (or more if desired) connector 20's are ganged together both physically and electrically. Note that each pair of movable connector legs 201A and 201B can be moved either together with the other pair or individually, depending upon how they are electrically or mechanically interconnected.

Figure 4:
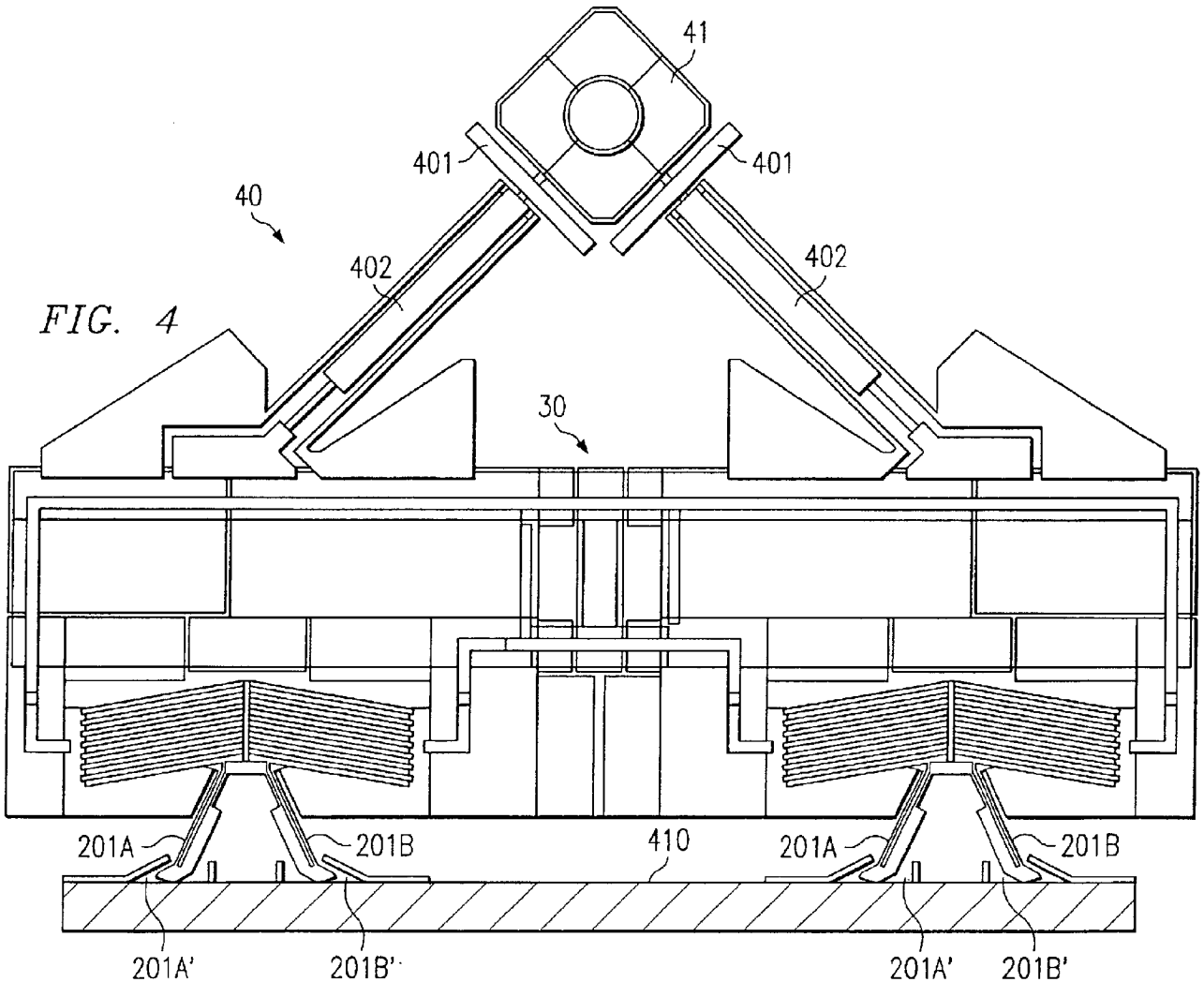
FIG. 4 shows the multiple configuration of FIG. 3 being used to position other elements.

FIG. 4 shows device 40 which has two pairs of controllably movable elements 201A and 201B, which can be two snap connectors as shown on FIG. 3 which latch into mating structures 201A' and 201B', respectively of structure 410. In addition, device 40 shows that device 40 can act to position another element, such as element 41, via plates 401 under control of arms 402. Arms 402, in turn, are actuators for moving plate 401 up and down.

Figure 5:
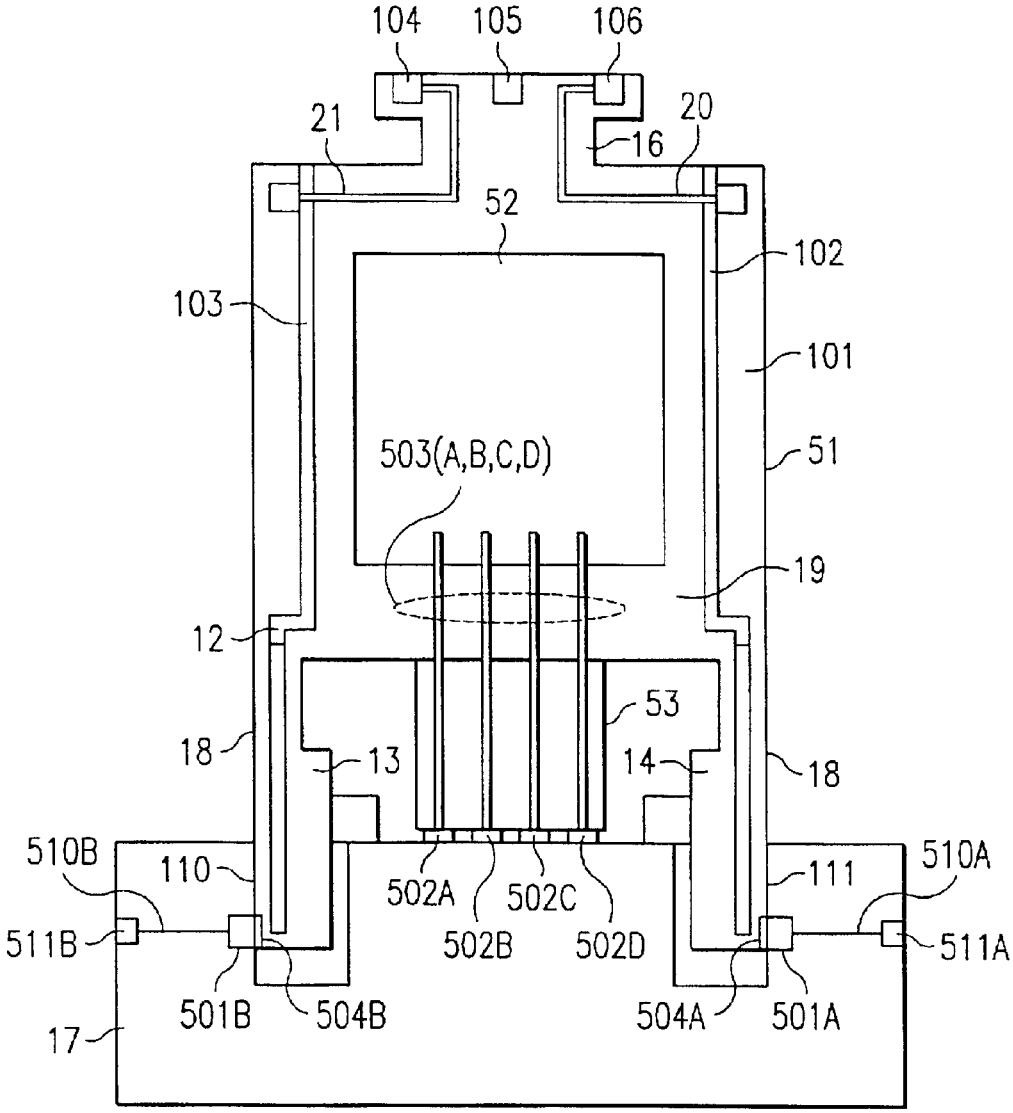
FIG. 5 shows a conceptual view of a device being mated to a surface where electrical connections are made.

FIG. 5 shows conceptual device 51, which is essentially the same as device 11, except that passive contact pad 53 has been added to allow for bringing connector 51 into electrical contact with substrate 17 via contacts 502A–502D. Also, if desired, there could be added electrical contact pads 501A and 501B which mate with contacts 504A and 504B, respectively. Note that one use for pads 501A and 501B would be to reenergize elements 14 to further expand elements 14, if and when necessary. This would be akin to using a feedback loop to maintain proper contact. Contact 511(A/B) can be used to supply power to contact 501(A/B) via powerline 510 (A/B). The expansion could be controlled by making a "reverse" bi-morph from sections of elements 13 and 14 such that elements 13 and 14 move outward upon the application of power to terminals 511A and 511B. The current connection for this could be, for example, from terminal 504A through arm 14 to and via connector 19 to arm 13 and terminal 504B. Connection between contacts 511A and 501A can be accomplished, for example, by making 510A a metal overlay running up side wall 111 and extending 501A to the surface.

The connectors shown in the FIGURES could, if desired, be constructed using the MEMS process. If MEMS is used, the addition of deformable sections can be incorporated into the manufacturing process for little additional cost. In addition, it should be noted that the actuators can be positioned in various locations around a connector, all of which need not be activated at one time. This would allow for the connection to multiple different structures at different times.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compostions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A connector having at least one element for mating with another element, said connector comprising:

means for supplying energy to said connector;

means controlled at least in part by the supplied energy, for deflecting at least one of said mating elements, said deflection being away from said deflecting element's at rest position; and means for releasing any said deflection in order to allow said elements to become latched in a fixed relationship with each other.

2. The connector as set forth in claim 1 further comprising:

means for mating together said elements while at least one of said elements is being deflected, said mating occurring under low insertion force due to said element being deflected.

3. The connector as set forth in claim 1 wherein said releasing means includes at least one bi-morph element.

4. The connector as set forth in claim 1 wherein the means controlled at least in part by the supplied energy is configured for the supplied energy to comprise electric power.

5. The connector as set forth in claim 1 wherein the means controlled at least in part by the supplied energy is configured for the supplied energy to comprise a magnetic field.

6. The connector as set forth in claim 1 wherein the means controlled at least in part by the supplied energy is configured for the supplied energy comprise hydraulic energy.

7. The connector as set forth in claim 1 wherein the means controlled at least in part by the supplied energy is configured for the supplied energy to comprise thermal energy.

8. The connector as set forth in claim 1 wherein said deflection means includes at least one bi-morph element.

9. The connector as set forth in claim 8 wherein said deflecting means includes means for transporting power through said connector to said bi-morph element.

10. A connector, said connector comprising a pair of elongated opposing mating elements;

a handle for positioning said elements with respect to a structure to which said elements are to be mated;

an energy transporter within said connector for circulating energy through said connector to said elongated elements; and said mating elements having within each of them a bi-morph region such that when energy is being circulated through said connector said elements deflect from their normal position wherein at least one of said elements has a structure designed to latch with a mating structure when mated and said energy ceases to be circulated.

11. A connector, said connector comprising a pair of elongated opposing mating elements;

a handle for positioning said elements with respect to a structure to which said elements are to be mated;

an energy transporter within said connector for circulating energy through said connector to said elongated elements; and said mating elements having within each of them a bi-morph region such that when energy is being circulated through said connector said elements deflect from their normal position wherein said handle includes power contacts for connecting to said energy to be transported through said connector.

12. A connector having at least one element for mating with another element, said connector comprising:

at least one bi-morph element for deflecting at least one of said mating elements, said deflection being away from said deflecting element's rest position; and means for selectively supplying energy to said deflecting element to control said deflection and to release said deflection wherein said deflection and release cause said element to become latched in a fixed relationship with each other.

* * * * *

UNITED STATES PATENT AND TRADEMARK OFFICE

CERTIFICATE OF CORRECTION

PATENT NO. : 6,837,723 B1
DATED : January 4, 2005
INVENTOR(S) : Randall et al.

It is certified that error appears in the above-identified patent and that said Letters Patent is hereby corrected as shown below:

Column 1,
Line 45, the word “clement” should be -- element --.

Column 5,
Lines 3 and 4, the word “compostions” should be -- compositions --.

Signed and Sealed this

Nineteenth Day of April, 2005

JON W. DUDAS
*Director of the United States Patent and Trademark Office*